US012240649B2

(12) United States Patent
Armeni et al.

(10) Patent No.: US 12,240,649 B2
(45) Date of Patent: Mar. 4, 2025

(54) METHOD AND A MACHINE FOR PRODUCING A PACKAGE OF SMOKING ARTICLES

(71) Applicant: G.D S.p.A., Bologna (IT)

(72) Inventors: Alan Armeni, Bologna (IT); Davide Parazza, Bologna (IT); Giuliano Gamberini, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 18/553,259

(22) PCT Filed: Mar. 21, 2022

(86) PCT No.: PCT/IB2022/052539
§ 371 (c)(1),
(2) Date: Sep. 29, 2023

(87) PCT Pub. No.: WO2022/208225
PCT Pub. Date: Oct. 6, 2022

(65) Prior Publication Data

US 2024/0174391 A1 May 30, 2024

(30) Foreign Application Priority Data

Mar. 30, 2021 (IT) ..... 102021000007763

(51) Int. Cl.
*B65B 9/02* (2006.01)
*B65B 13/02* (2006.01)
(Continued)

(52) U.S. Cl.
CPC ..... *B65B 9/02* (2013.01); *B65B 13/02* (2013.01); *B65B 17/02* (2013.01); *B65B 35/44* (2013.01); *B65B 41/16* (2013.01); *B65B 61/06* (2013.01)

(58) Field of Classification Search
CPC ..... B65B 9/02; B65B 11/02; B65B 11/06; B65B 11/105; B65B 11/12; B65B 11/50;
(Continued)

(56) References Cited

U.S. PATENT DOCUMENTS 2,456,059 A * 12/1948 Grupe ..... B65B 17/02 156/562
3,807,117 A * 4/1974 Abrams ..... B65B 21/245 53/553
(Continued)

FOREIGN PATENT DOCUMENTS

GB 537852 A 7/1941
NL 9301786 A 5/1995

OTHER PUBLICATIONS

International Search Report and Written Opinion dated Jun. 13, 2022. 13 pages.

*Primary Examiner* — Gloria R Weeks
(74) *Attorney, Agent, or Firm* — RMCK Law Group PLC

(57) ABSTRACT

A method for producing a package of smoking articles having an ordered group of packets arranged in mutual contact, including: advancing the packets in a row and receiving one packet after another between a first and a second ring-shaped moving member, accumulating the packets between the moving members so as to extend the row of packets, without interruptions, between the moving members; applying onto the accumulated packets, a continuous band of adhesive sheet; separating by a given distance an ordered group of packets from the remaining packets of the row, which are located upstream of the moving members; cutting the band at a tract within the distance between the ordered group of packets and row of packets, so as to separate a strip of adhesive sheet from the
(Continued)

band, which is applied to the ordered group of packets and holds together the packets of the group.

12 Claims, 7 Drawing Sheets

(51) Int. Cl.
*B65B 17/02* (2006.01)
*B65B 35/44* (2006.01)
*B65B 41/16* (2006.01)
*B65B 61/06* (2006.01)

(58) Field of Classification Search
CPC ..... B65B 13/00; B65B 13/02; B65B 13/04; B65B 13/20; B65B 35/44; B65B 61/06
See application file for complete search history.

(56) References Cited

U.S. PATENT DOCUMENTS 3,837,138 A * 9/1974 Terry ..... B65B 63/026 53/553
4,858,416 A * 8/1989 Monaghan ..... B29C 66/836 53/553
4,870,802 A * 10/1989 Cerf ..... B65B 9/02 53/76
4,932,190 A * 6/1990 Bergner ..... B65G 47/082 53/73
5,042,229 A * 8/1991 Hirose ..... B65B 9/073 53/550
5,107,659 A * 4/1992 Davis ..... B65B 9/026 53/553
5,979,145 A * 11/1999 Louis ..... B65B 63/022 53/436
7,475,525 B2 * 1/2009 Focke ..... B65D 85/1072 53/158
7,481,033 B2 * 1/2009 Ouellette ..... B65B 9/02 53/553
7,503,153 B2 * 3/2009 De Matteis ..... B65B 11/10 53/223
7,941,992 B2 * 5/2011 Spatafora ..... B65B 35/44 53/251
8,549,823 B2 * 10/2013 Pipes ..... B65B 51/10 53/442
8,950,164 B2 * 2/2015 Resta ..... B65B 9/026 53/228
9,061,778 B2 * 6/2015 Downhill ..... B65B 11/008
9,623,989 B2 * 4/2017 Loevenich ..... B65B 5/06
2006/0059863 A1 * 3/2006 Michler ..... B65B 11/10 53/399
2012/0234712 A1 * 9/2012 Moore ..... B65D 71/02 206/391
2012/0279882 A1 * 11/2012 Prahm ..... B65D 85/1072 53/148
2016/0144986 A1 * 5/2016 Jauch ..... B65B 27/08 100/2

* cited by examiner

METHOD AND A MACHINE FOR PRODUCING A PACKAGE OF SMOKING ARTICLES

CROSS-REFERENCE TO RELATED APPLICATIONS

This application is a 371 National Stage of International Application No. PCT/IB2022/052539, filed Mar. 21, 2022, which claims priority to Italian Patent Application No. 102021000007763 filed Mar. 30, 2021. The disclosure of each of the above applications is incorporated herein by reference in its entirety.

FIELD OF THE INVENTION

The present invention relates to a method and a machine for producing a package of smoking articles comprising an ordered group of packets containing smoking articles and arranged in mutual contact.

It should be noted that, in the present text, reference will be made indiscriminately to the specific example of "cigarettes" rather than to the more generic expression "smoking articles", without however losing generality in relation to other types of articles (such as cigars, cigarettes or cigarillos, electronic cigarettes or ecgis, auxiliary products such as filters, refills for ecgis and other tobacco-based products or with alternative or tobacco-replacement components).

STATE OF THE ART

Nowadays, also in the field of packaging of smoking articles, the need is increasingly felt to reduce the use of material for producing a single package, in order to limit the environmental impact of the package.

Normally, a package of cigarette packets (commonly called "carton") consists of a container made from a folded and glued sheet of cardboard, and an outer envelope made from a sheet of polymeric material, wrapped around the container. Another widely used type of carton of cigarette packets comprises only the outer casing, made from the sheet of polymeric material, which encloses the packets of cigarettes inside.

In this context, the present invention proposes a solution for producing a new package of packets of cigarettes (more generally, of smoking articles), which comprises only one or more strips of adhesive sheet, which hold together an ordered group of packets.

The new package, therefore, presents an essential structure that is reduced to just the elements necessary to hold the packets of the package together.

In general, the present invention relates to a method according to claim 1 and a machine according to claim 11.

The claims form an integral part of the technical disclosure provided here.

BRIEF DESCRIPTION OF THE DRAWINGS

Further characteristics and advantages of the invention will become evident from the description that follows with reference to the attached drawings, provided purely by way of non-limiting example, wherein.

DETAILED DESCRIPTION

In the following description various specific details are illustrated aimed at a thorough understanding of the embodiments. The embodiments may be implemented without one or more of the specific details, or with other methods, components, materials, etc. In other cases, known structures, materials or operations are not shown or described in detail to avoid obscuring various aspects of the embodiments.

The references used here are only for convenience and do not therefore define the field of protection or the scope of the embodiments.

As anticipated above, the solution described here relates to a method and a machine for producing a package of smoking articles comprising an ordered group of packets containing smoking articles and arranged in mutual contact.

The solution described here allows a new package to be produced comprising only one or more strips of adhesive sheet, which hold together an ordered group of packets.

Figure 4:
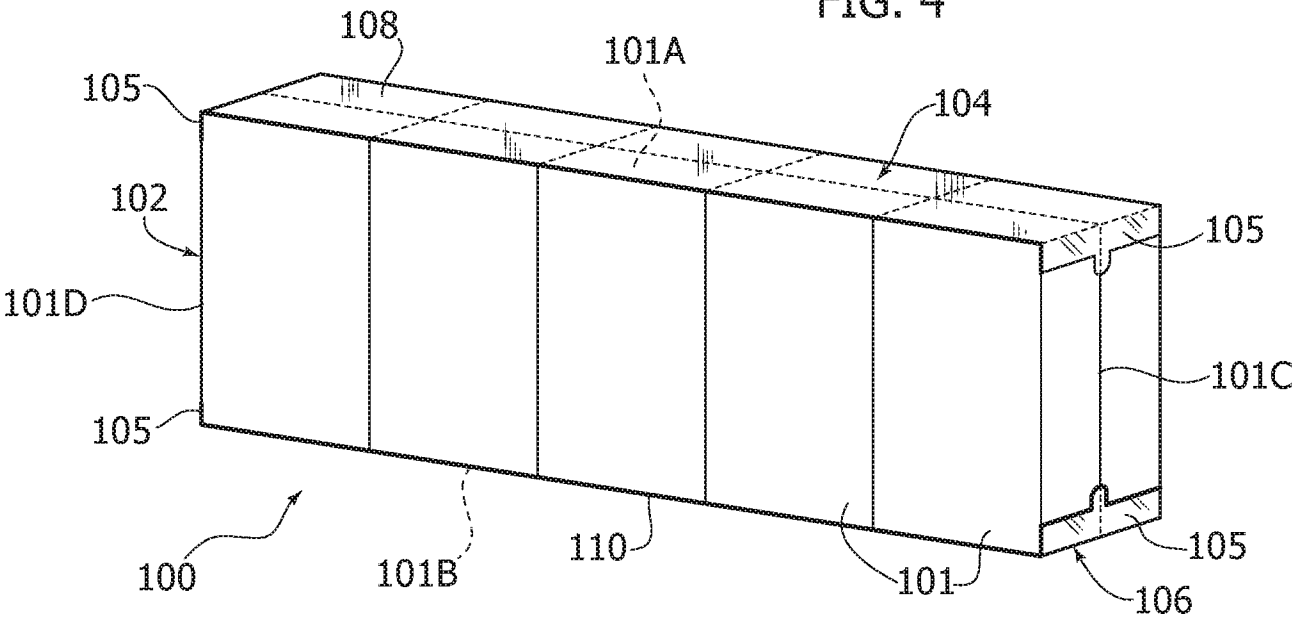
FIG. 4 represents an example of the new package described here.

FIG. 4 illustrates an example of the new package. With reference to this Figure, the new package—indicated as a whole with the reference number 100—comprises an ordered group 102 of packets 101, and two strips of adhesive sheet, 104, 106, applied on opposite sides or surfaces 108, 110 of the group of packets.

The two sides 108, 110 are each defined by the set of homologous sides or surfaces (i.e. for example, the head or base surfaces of a packet when it is arranged in a vertical position) of all the packets 101 of the group 102, so that the two strips 104, 106 can come into contact with all the packets 101.

The solution described here envisages producing this new type of package using an adhesive sheet band unwound from a reel, which is directly applied to the packets and cut to size according to the size of the group of packets of the package. The solution described here does not generate any waste material and is limited to the use of the material necessary for making the indicated strips.

Figure 1:
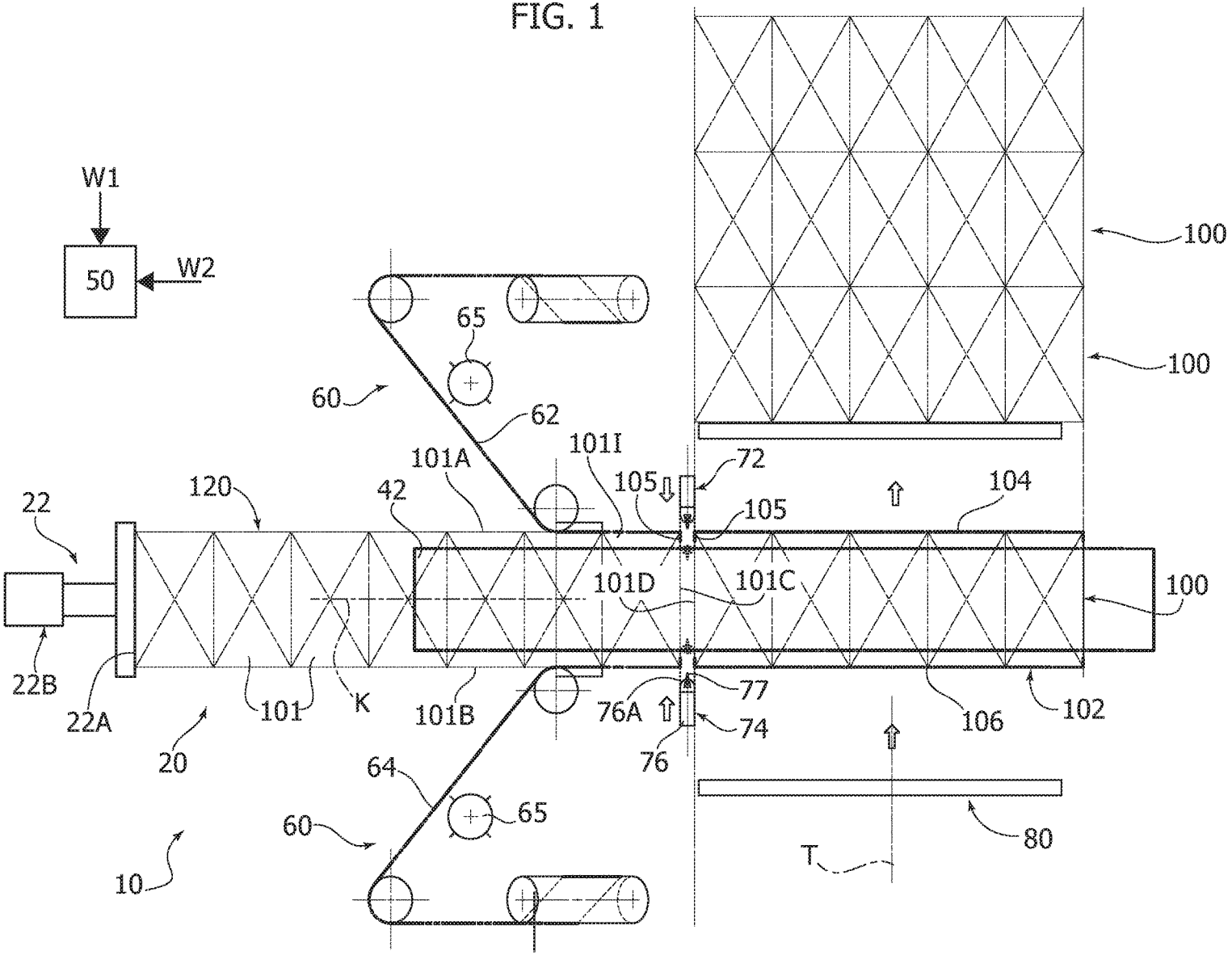
FIG. 1 schematically represents an example of a packaging machine according to the present invention, in a plan view.
Figure 2:
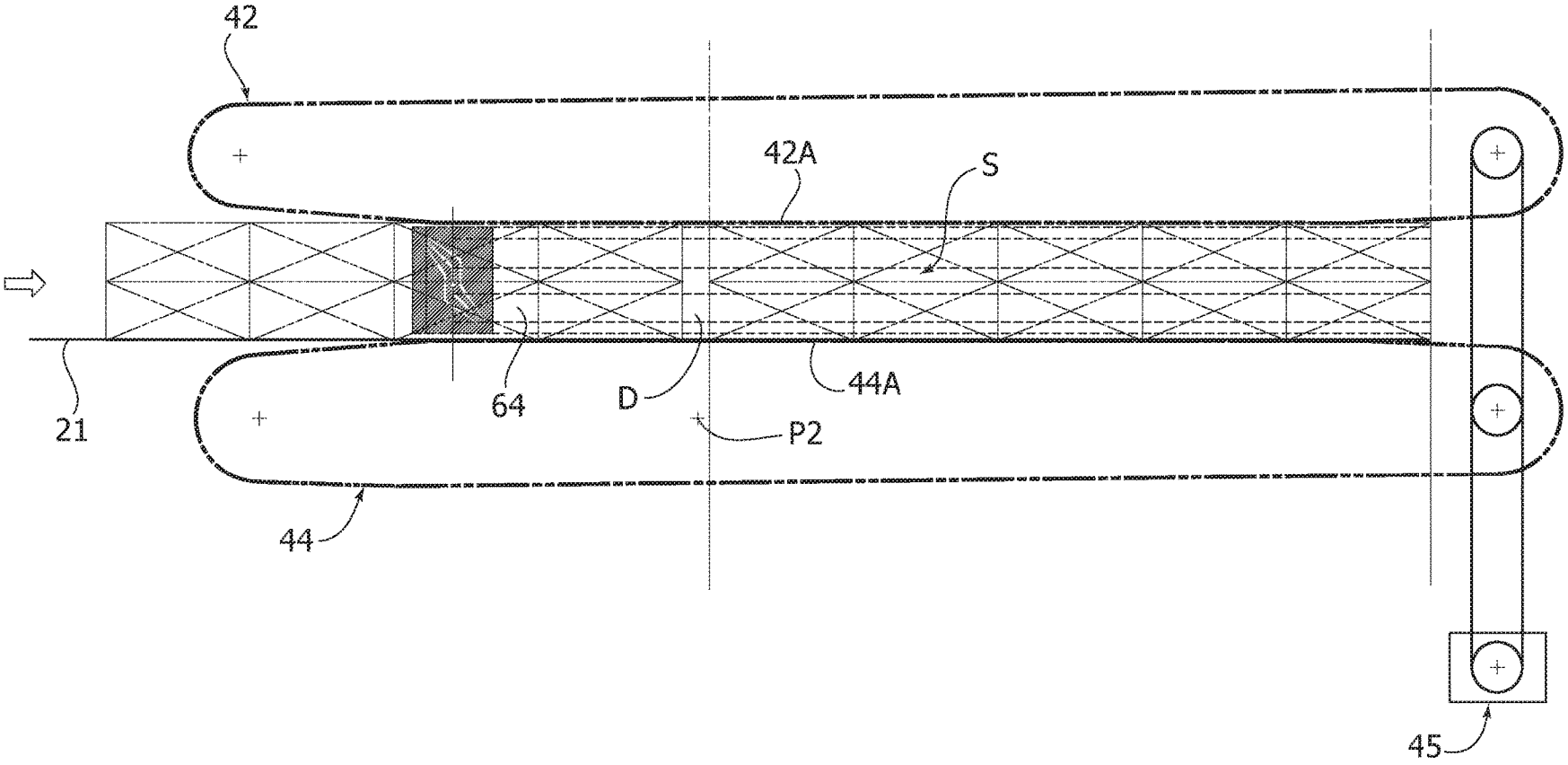
FIG. 2 represents a side view of a detail of the machine of FIG. 1.

FIG. 1 represents an example of a packaging machine for producing the new package.

In one or more preferred embodiments, such as the one illustrated, the machine described here—indicated as a whole with the reference number 10—comprises a transport device 20 for advancing the packets 101 along a direction of advancement K according to an arrangement wherein the packets 101 are arranged in a row along the direction of advancement K, each packet being in contact at least with one respective packet that precedes it, and with one respective packet following it, along the same direction.

In the example illustrated, the row of packets—indicated as a whole with the reference number 120—comprises, for each position along the K direction, a pair of side-by-side packets. The number of packets for each position may, however, vary according to the needs of the specific applications; for example, it may be equal to 1 or 3.

In one or more preferred embodiments, such as the one illustrated, the transport device 20 comprises a sliding track 21, and a unit 22 to push the packets 101 so as to make them slide on the track 21 along the direction of advancement K.

The pusher unit 22 comprises a pusher member 22A movable with reciprocating motion along the direction K and controlled by an actuator 22B.

The machine 10 also comprises a first and a second ring-shaped moving member 42, 44, which have respective sections 42A, 44A, opposite each other, which extend along the direction of advancement K, and are movable along the same direction. The sections 42A, 44A are arranged to receive, in the space S formed between them, the packets 101, and to make them advance along the same direction.

The two moving members 42, 44 are controlled by an actuator 45.

For simplicity of discussion, the illustrated example refers to a single actuator for controlling the two members 42, 44, but it is clear that the two members may also be controlled, each one, by a respective independent actuator.

The machine 10 comprises a control unit 50 for driving the actuator 22B and the actuator 45 indicated above.

In one or more preferred embodiments, such as the one illustrated, the control unit 50 is configured to drive the actuator 22B so as to cause, through the pusher member 22A, a stepwise movement of the packets 101 on the track 21.

Preferably, the pitch achieved is equal to the size of a single packet 101 along the direction of advancement K.

The control unit 50 is configured to drive the actuator 45 so as to actuate the two members 42, 44 according to a stepwise movement synchronized with the movement of the packets determined by the pushing member 22A.

In general, the two moving members 42, 44 perform the function of separating, one after the other, ordered groups of packets from the row of packets on the track 21; the groups of packets separated by the two members 42, 44 form the packages made by the machine.

To perform this function, the two moving members 42, 44 operate in the manner described below.

As shown in FIGS. 3A to 3D, the two members 42, 44 are initially operated to receive, one after the other, the pairs of packets 101 and accumulate them in the space S, so as to extend the row of packets 120, without interruptions, along the direction of advancement, on the track 21, within the space S.

To this end, the two members 42, 44 are operated by the actuator 45 according to a movement that follows the same law of motion as the pusher member 22A.

In this way, a flow of packets 101 along the direction K is evidently determined, which is homogeneous along the track 21 and the two members 42, 44, and which, therefore, allows the row of packets 120 to also extend inside the space S between the two moving members 42, 44.

This first mode of operation is maintained until the number of packets received and accumulated between the two members 42, 44 is equal to a predetermined number.

Once this condition has been reached, in the following step, the two members 42, 44 are, on the contrary, operated according to a movement that follows a law of motion that is different from that of the pusher member 22A, so as to separate a group of packets 102 from the row of packets 120 by dragging them forward along the K direction.

The group 102 contains a number of packets equal to a given number for the package 100 to be made.

Figure 3A:
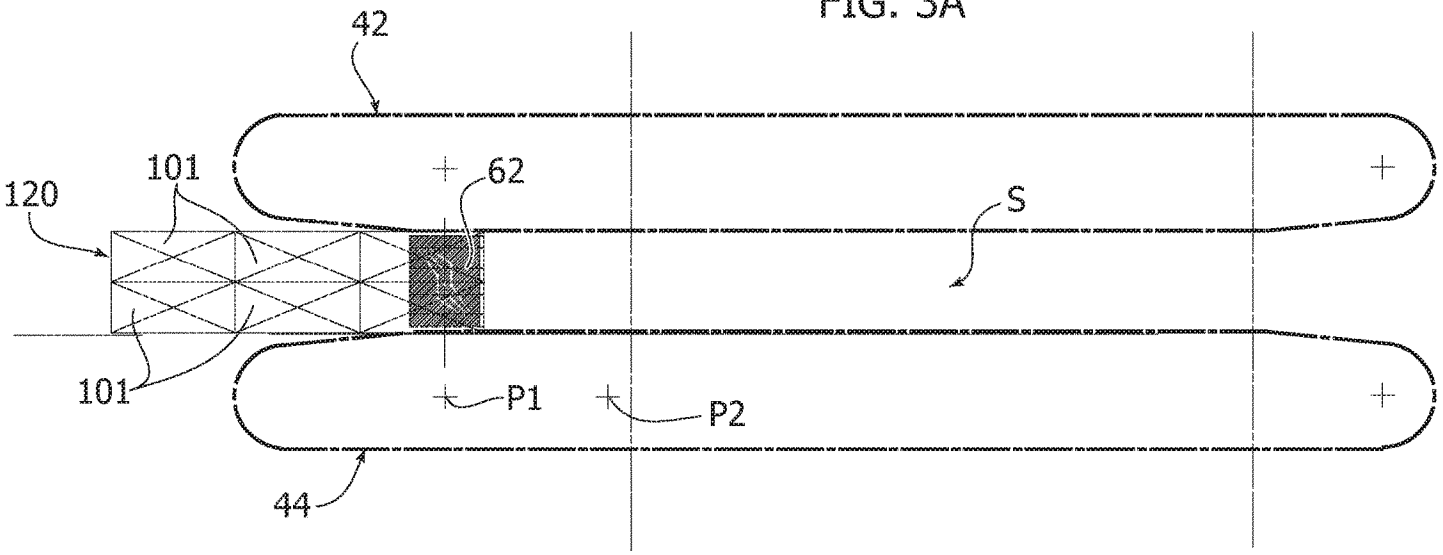
FIGS. 3A to 3G represent successive steps of an example of the packaging method according to the present invention.
Figure 3B:
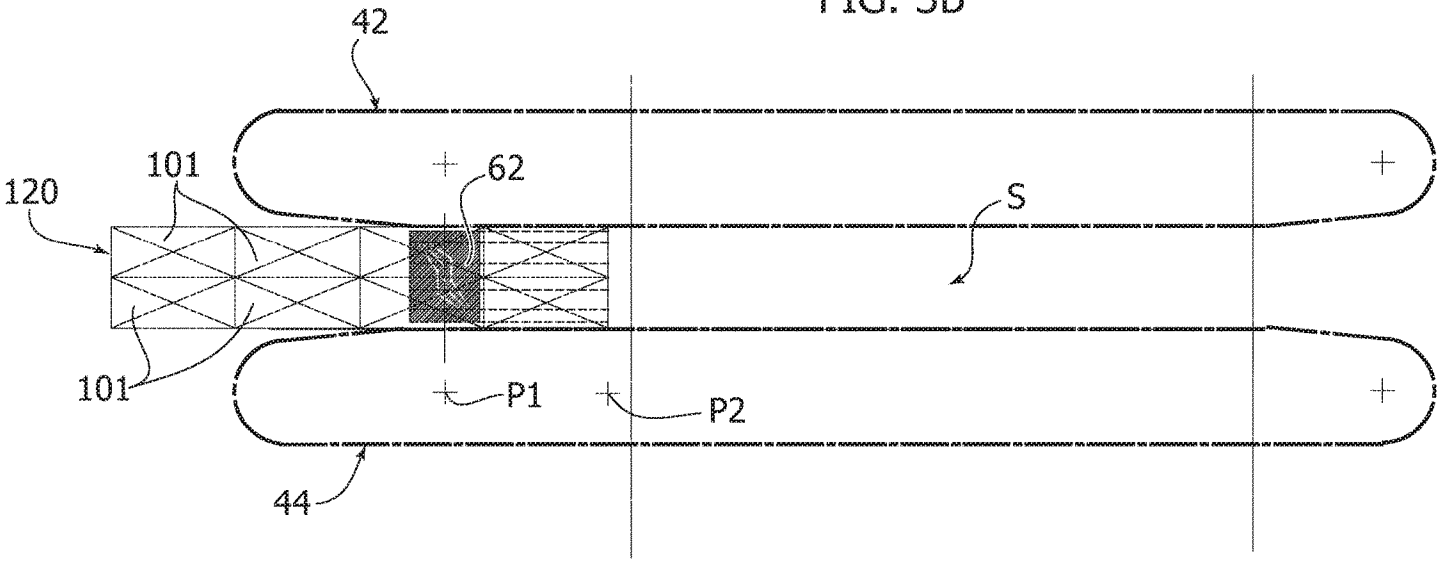
Figure 3C:
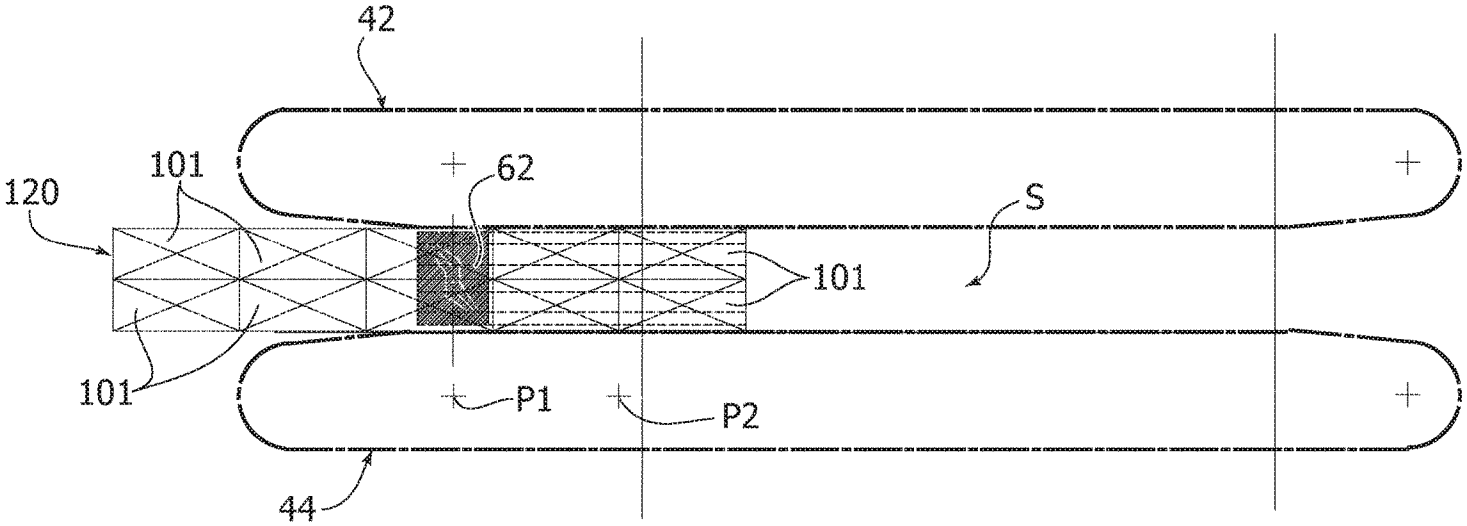
Figure 3D:
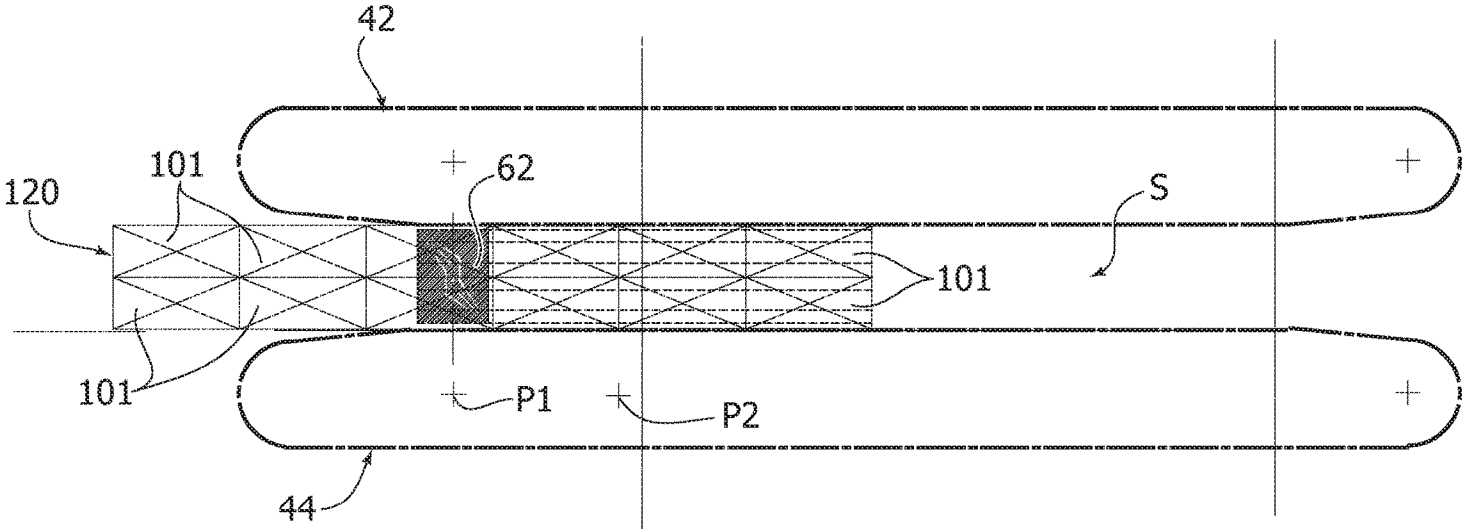

In the example illustrated, the first mode of operation is maintained until the number of packets received and accumulated between the two members 42, 44 is equal to the predetermined number for a package, or rather, ten packets, minus the number of packets present in each position of the row of packets 120, or rather, two packets (FIG. 3D).

The law of motion followed by the two members 42, 44 is such so that the movement of the two members 42, 44 is initially equal to that of the pusher member 22A, in order to receive another pair of packets 101 and thus form, inside the space S, the group of packets 102, and, subsequently, provides a greater acceleration, along the direction of advancement K, so as to separate the group of packets 102 from the row of packets 120. The group 102 is separated from the row of packets 120 by a given distance D.

In alternative embodiments, the first mode of operation is instead maintained until the number of packets received and accumulated between the two members 42, 44 is exactly equal to the given number for the package 100. In this case, the law of motion followed by the two members 42, 44 may provide a greater acceleration already from the initial instant of the step in question.

The predetermined number may be detected on the basis of one or more operating data of the pusher unit 22 and/or of the two moving members 42, 44. Alternatively, the machine 10 may comprise at least one sensor for counting the number of packets that are inserted between the two moving members 42, 44.

The control unit 50 is configured to receive the operating data (indicated with W1 in FIG. 1) and/or the data (W2) indicative of the number of packets between the two moving members 42, 44, and to control the two members 42, 44 according to these data.

Figure 3E:
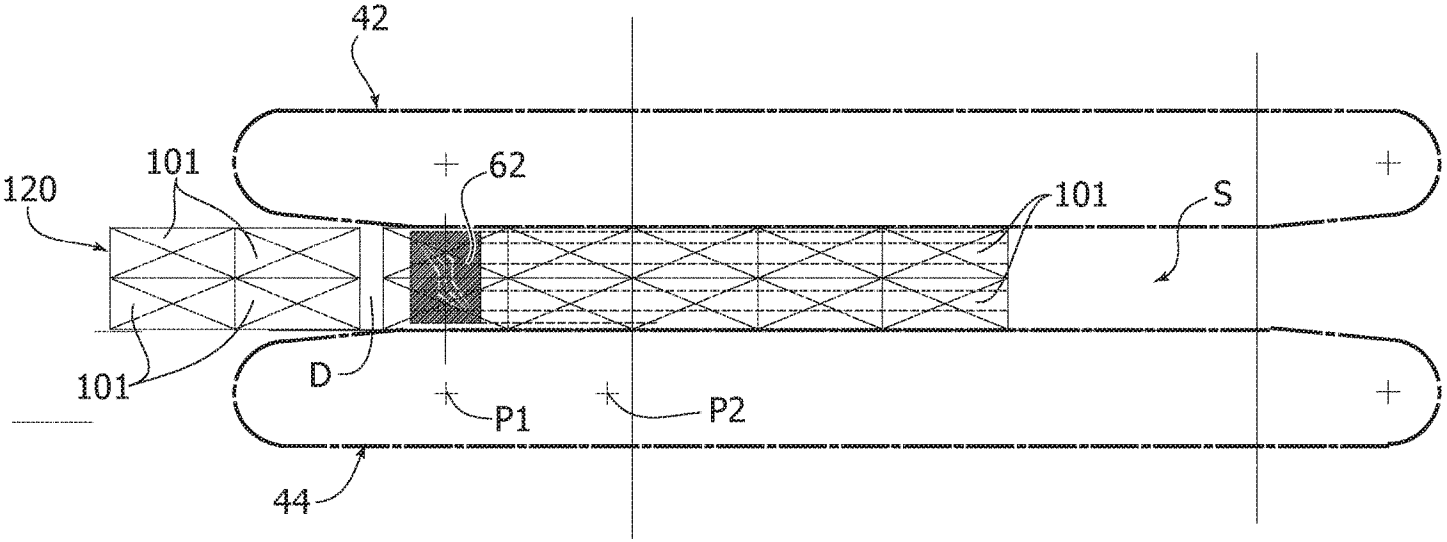
Figure 3F:
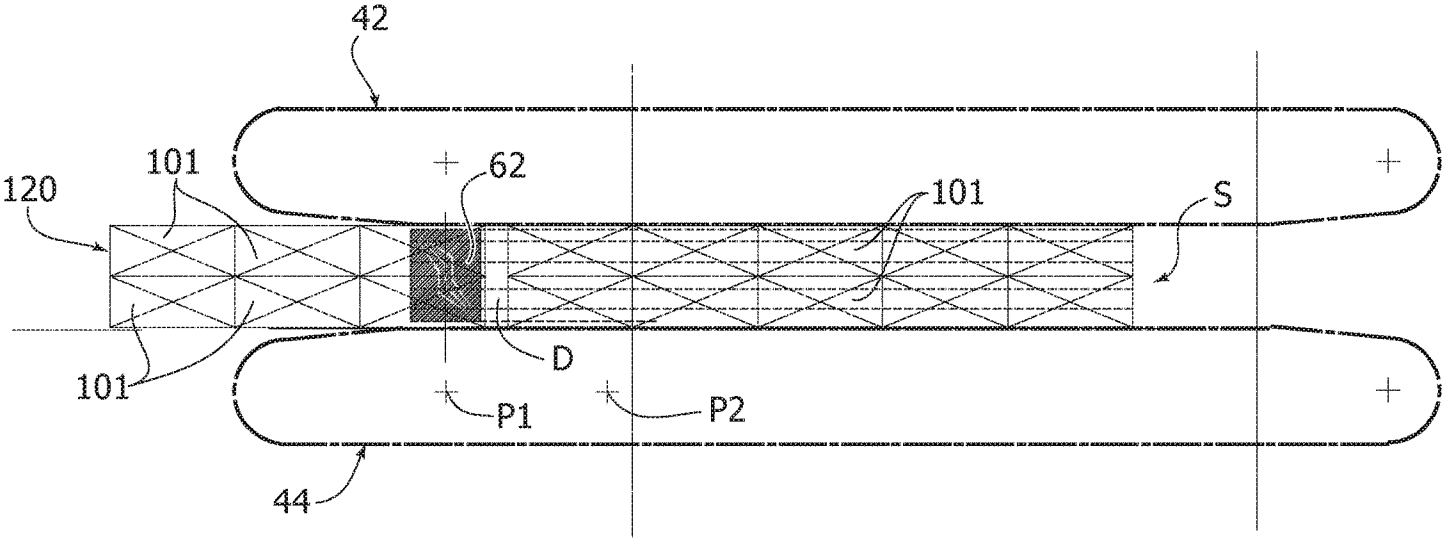
Figure 3G:
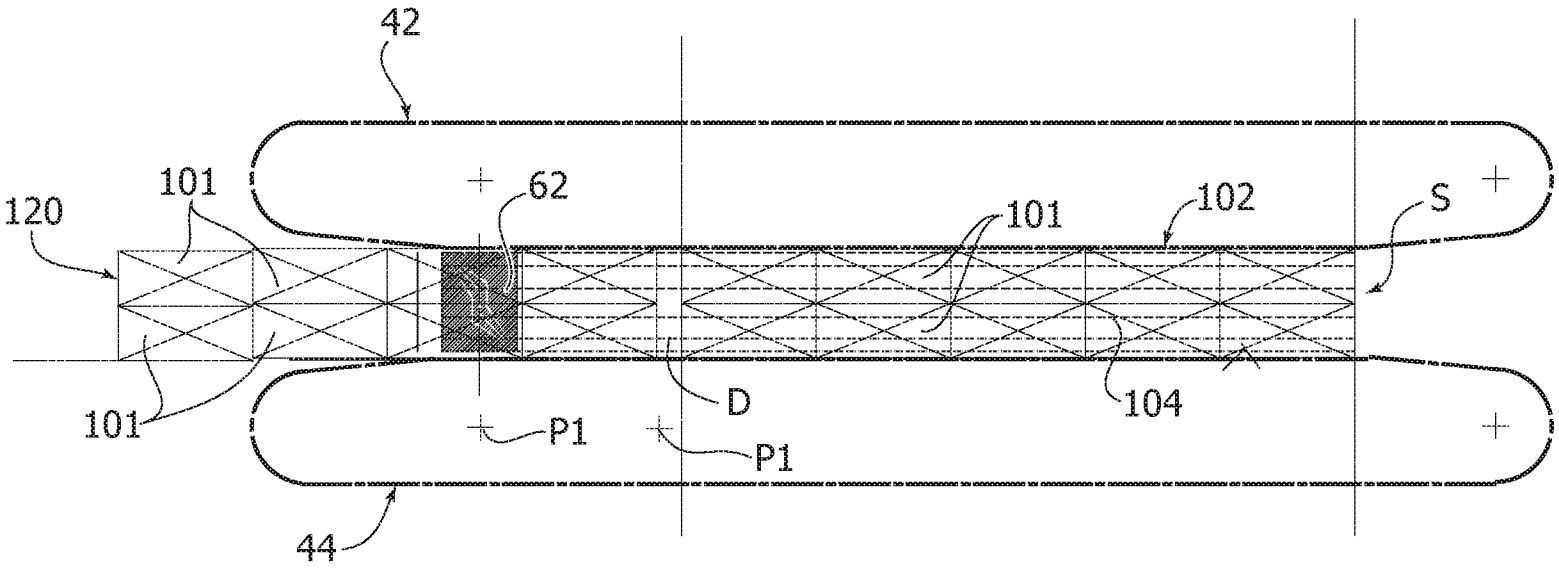

As illustrated in FIG. 3E, at the end of the step discussed, the group of packets 102 is found separated and spaced apart from the row of packets 120, and a new packet 101I of the row 120, which corresponds to the first packet downstream after the separation of the group 102, is brought between the two members 42, 44. In the next step, the two members 42, 44 return to be operated according to the same law of motion as the pusher member 22A to extend again the row of packets 120 inside the space S between the two members (FIGS. 3F and 3G).

This operating mode is maintained until the number of packets received and accumulated between the two members 42, 44 reaches the aforesaid predetermined number.

Returning to the structure of the machine 10 (FIG. 1), this further comprises a system 60 for simultaneously feeding two continuous bands 62, 64 of adhesive sheet, unwound from a reel, and applying them on opposite sides 101A, 101B of the packets 101, which are accumulated between the two moving members 42, 44. The opposite sides 101A, 101B are parallel to the direction of advancement K, and are arranged on planes which simultaneously contain the homologous sides of all the packets 101 accumulated between the two members 42, 44.

The system 60 can, for example, comprise a plurality of rollers, motorized or not, to feed and guide each band from the relative reel to a position P1 wherein the band, 62 or 64, comes into contact with the side 101A or 101B of a packet 101 which is located at the same position.

Incidentally, it should be noted that the system 60 may be of any known type, suitable for the objects indicated, so that further details of this system will not be provided so as not to burden the present discussion.

The machine 10 further comprises two cutting members 72, 74 for cutting the two bands 62, 64 applied onto the packets 101.

In one or more preferred embodiments, such as the one illustrated, the two cutting members 72, 74 are arranged to cut the two bands 62, 64 at a position P2 wherein, during operation, the aforesaid distance D is determined between the group of packets 102 and the row of packets 120.

In this way, the cutting action performed by the two members 72, 74 allows two strips 104, 106, of adhesive sheet to be separated from the two continuous bands 62, 64, which are already applied onto the group of packets 102.

In one or more preferred embodiments, such as the one illustrated, the position P2 is arranged downstream of the position P1, displaced by a distance equal to at least one pitch of the advancement movement caused by the pusher member 22A. In this way, before being cut, the bands 62, 64 are applied both onto the group of packets 102 and at least on the first packet 101I of the row 120 and, therefore, they are perfectly stretched at their respective sections subtended by the distance D.

This facilitates the cutting action of the bands 62, 64 by the two cutting members 72, 74.

In general, the distance D must be sufficient to allow the cutting members 72, 74 to insert themselves between the group of packets 102 and the row of packets 120 to cut the bands 62, 64 without damaging the adjacent packets.

Preferably, the distance D is at least equal to 1 mm.

In one or more preferred embodiments, such as the one illustrated, the two cutting members 72, 74 are arranged to fold the end flaps 105, generated by cutting, of the bands 62, 64 and of the strips 104, 106, respectively, against the adjacent side 101C, orthogonal to the direction K, of the packet 101I, and against the adjacent side 101D, also orthogonal to the direction K, of the group of packets 102.

In this case preferably, the distance D is equal to at least 5 mm.

In one or more preferred embodiments, such as the one illustrated, in order to perform the indicated folding function, each cutting member 72, 74 comprises a base body 76, the cross-section of which is characterized by a substantially equal width, or in any case slightly lower, at the distance D.

The base body 76 has an end edge 76A, on which the cutting blade 77 of the cutting member 72, 74 is fixed, which has a rounded shape or—in any case—shaped to define a gradual increase in width, from a minimum value at a central region wherein the cutting blade 77 is located, up to the maximum value equal to the distance D.

In one or more embodiments, the system 60 may comprise scoring rollers 65 to produce on the bands 62, 64 fed to the position P1, a succession of pre-cutting lines 67, according to a pitch such that each pre-cutting line 67 is found at the section of the band subtended by the distance D, in the operating step illustrated in FIG. 3F.

The pre-cutting lines 67 have the function of facilitating a controlled tearing of the bands 62, 64, during the cutting operation, along predefined lines, which are precisely identified by the pre-cutting lines.

In one or more preferred embodiments (FIG. 5), the pre-cutting lines 67 have a generic U-shape, so as to define a notch and a protruding flap, respectively, on the opposite end flaps 105 of the strips 104, 106 made by cutting the bands 62, 64.

Figure 5:
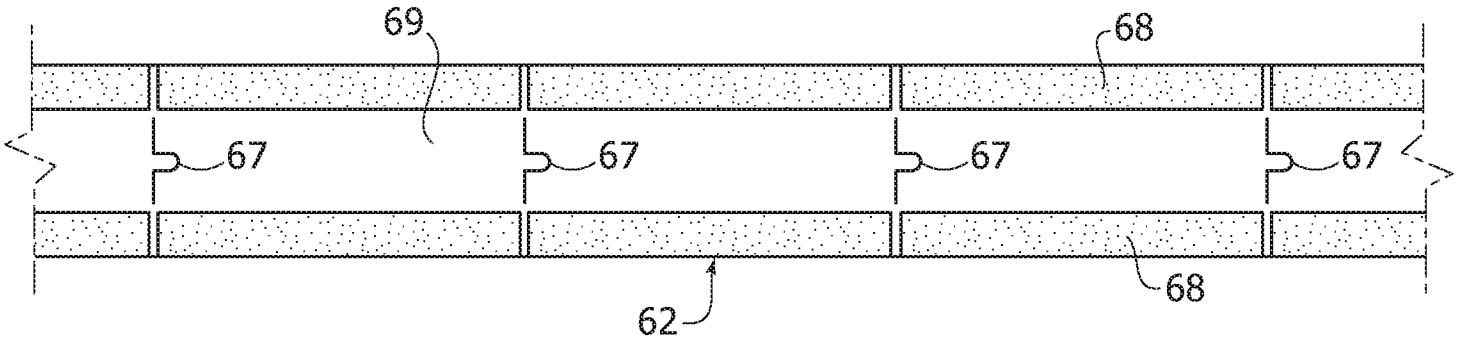
FIG. 5 represents an example of an adhesive sheet band for producing the package described here.

In this case, illustrated in FIG. 5, the bands 62, 64 are preferably covered with adhesive material at two strips 68 parallel and spaced apart along a direction transversal to the longitudinal extension of the bands, so as to obtain a central strip 69 without any adhesive material, on which the pre-cutting lines 67 are obtained by means of the scoring rollers 65.

This solution offers the advantage of preventing the blades of the scoring rollers from becoming dirty with adhesive material, causing a malfunction of the system.

Returning to FIG. 1, in one or more preferred embodiments, such as the one illustrated, the machine 10 also comprises a pushing member 80 for pushing the ordered group of packets 102, on which the strips 104, 106 are applied that hold together the packets 101 of the group, along a direction T transverse to the direction of advancement K, to feed a succession of ordered groups of packets 102 to a collection station (not shown).

Of course, without prejudice to the principle of the invention, the details of construction and the embodiments may vary, even significantly, with respect to those illustrated here, purely by way of non-limiting example, without departing from the scope of the invention as defined by the attached claims.

The invention claimed is:

1. A method for producing a package of smoking articles comprising an ordered group (102) of packets (101) containing smoking articles and arranged in mutual contact, wherein said group of packets (102) has at least one side or one surface (108, 110) that is defined by a totality of homologous sides or surfaces of all the packets (101), the method includes:

advancing the packets (101) along a direction of advancement (K) according to an arrangement wherein the packets are arranged in a row along the direction of advancement (K), each packet being in contact with at least one respective packet that precedes it, and with a respective packet that follows it, along the direction of advancement (K), wherein advancing the packets (101) includes moving the packets according to a first predetermined motion law;

receiving at least one packet after another of a row of packets (120) between a first and a second ring-shaped moving members (42, 44), and accumulating the packets between the first and the second ring-shaped moving members (42, 44), so as to extend the row of packets (120), without interruptions, along the direction of advancement (K), between the first and the second ring-shaped moving members (42, 44);

wherein accumulating the packets (101) includes, by means of the first and the second ring-shaped moving members (42, 44), advancing the packets (101) along the direction of advancement (K) according to a second predetermined motion law that is identical to the first predetermined motion law;

applying onto the packets (101) that are received and accumulated between the first and the second ring-shaped moving members (42, 44), at least one continuous band (62, 64) of adhesive sheet, which is unwound from a reel, on corresponding surfaces (101A, 101B) of the packets that are parallel to the direction of advancement (K), and are arranged on a same plane containing the homologous surfaces of all the packets (101) accumulated between the first and the second ring-shaped moving members (42, 44), when the packets (101) received between the first and the second ring-shaped moving members (42, 44) have reached a predetermined number of packets, by means of the first and the second ring-shaped moving members (42, 44), the method includes advancing the packets according to the second predetermined motion law that is different from the first predetermined motion law, so as to separate by a given distance (D) an ordered group of packets (102) from remaining packets of the row of packets (120), which are positioned upstream of the first and second ring-shaped moving members (42, 44);

cutting the at least one continuous band (62, 64) at a tract within the given distance (D) between the ordered group of packets (102) and the row of packets (120), so as to separate from the at least one continuous band (62, 64) a strip (104, 106) of adhesive sheet that is applied to the ordered group of packets (102) and holds the packets of the ordered group together of packets, said method comprising, before cutting the band:

receiving new packets (101I) between the first and the second ring-shaped moving members (42, 44), and accumulating the new packets between them, so as to extend the row of packets (120), without interruptions, along the direction of advancement (K), between the first and the second ring-shaped moving members (42, 44), applying the at least one continuous band (62, 64) unwound from the reel onto the new packets (101I), which are received and accumulated between the first and the second ring-shaped moving members (42, 44); and wherein the step of cutting the at least one continuous band includes cutting the at least one continuous band (62, 64) at a tract of the at least one continuous band that is subtended by the distance (D) obtained between the ordered group of packets (102) and the row of packets (120) extended between the first and the second ring-shaped moving members (42, 44), this cutting step defining a new end (105) of the at least one continuous band, which is applied to at least one first packet (101I) of the new packets received between the first and the second ring-shaped moving members (42, 44), wherein the step of cutting includes folding an end edge of the strip (104, 106) separated from the at least one continuous band, against a side or a lateral surface (101D) of the ordered group of packets (102) that is orthogonal to the direction of advancement (K) and faces towards the new packets (101I) received between the first and the second ring-shaped moving members (42, 44), and includes folding the end edge (105) of the at least one continuous band (62, 64) against a side or a lateral surface (101C) of the at least one first packet (101I) of the new packets that is orthogonal to the direction of advancement (K) and faces towards the ordered group of packets (102).

2. The method according to claim 1, wherein the given distance (D) is equal to 1 mm.

3. The method according to claim 1, wherein the given distance (D) is at least-equal to 5 mm.

4. The method according to claim 1, wherein advancing the packets includes advancing the packets along the direction of advancement (K) according to a stepwise movement.

5. The method according to claim 1, wherein the second predetermined motion law includes an acceleration along the direction of advancement that is greater than the acceleration along the direction of advancement of the first predetermined motion law.

6. The method according to claim 1, which includes, after the step of cutting, pushing the ordered group of packets held together by the strip (104, 106) of adhesive sheet along a direction (T) that is transversal to the direction of advancement (K), for feeding a succession of ordered groups of packets (102) to a collecting station.

7. The method according to claim 1, wherein the group of packets (102) comprises a predetermined number of packets that is equal to a reference number, and the predetermined number is equal to the reference number, or to the reference number minus a number of packets that are set side-by-side along a direction that is transversal to the direction of advancement (K) at any position of the row of packets (120) along the direction of advancement (K).

8. The method according to claim 1, comprising the step of making a series of pre-cutting lines (67) on the at least one continuous band (62, 64), before it is applied onto the packets (101), said pre-cutting lines being made along a longitudinal direction of the band, each pre-cutting line being spaced apart from a following ene-pre-cutting line by a pitch so that a single pre-cutting line (67) finds itself on a tract of the at least one continuous band that is subtended by the given distance (D) between the group of packets (102) and the row of packets (120).

9. The method according to claim 8, wherein the at least one continuous band (62, 64) has an adhesive layer along two longitudinal strips (68) that are spaced apart from one another, between which a strip (69) without adhesive material is obtained, on which the series of pre-cutting lines (67) is made.

10. The method according to claim 1, wherein, after the packets have advanced according to the second predetermined motion law that is different from the first predetermined motion law, the method includes advancing the packets again by means of the first and second ring-shaped moving members (42, 44), according to the first predetermined motion law, for extending again the row of packets (120), without interruptions, along the direction of advancement (K), between the first and the second ring-shaped moving members (42, 44), until the packets (101) received between the first and the second ring-shaped moving members (42, 44) have reached a predetermined number of packets.

11. A machine for producing a package of smoking articles comprising an ordered group (102) of packets (101) containing smoking articles and arranged in mutual contact, wherein said group of packets (102) has at least one side or one surface (108, 110) that is defined by a totality of all the packets (101) of the group, the machine comprising:

a transport device (20) for advancing the packets along a direction of advancement (K) according to an arrangement wherein the packets are arranged in a row (120) along the direction of advancement (K), each packet of the packets being in contact with at least one respective packet that precedes it, and with a respective packet that follows it, along the direction of advancement (K), a first and a second ring-shaped moving members (42, 44), having respective opposed sections (42A, 44A) that extend along a direction of advancement (K), and are movable along a same direction, the first and the second ring-shaped moving members (42, 44) being configured to receive within a space(S) between them at least one packet after another of the row of packets (120), and to advance the packets along the direction of advancement (K) so as to accumulate the packets, thus extending the row of packets (120), without interruptions, along the direction of advancement (K), between the first and the second ring-shaped members (42, 44)

a system for feeding at least one continuous band (62, 64) of adhesive sheet, which is unwound from a reel, and applying the at least one continuous band onto the packets (101) that are received and accumulated between the first and the second ring-shaped moving members (42, 44), on corresponding surfaces (101A, 101B) of the packets (101), which are parallel to the direction of advancement (K) and are arranged on a same plane containing homologous surfaces of all the packets (101) accumulated between the first and the second ring-shaped moving members (42, 44), a control unit (50);

wherein the control unit is configured to control the transport device (20) for moving the packets along the direction of advancement according to a first predetermined motion law, and wherein the control unit is configured to control the first and the second ring-shaped moving members (42, 44) for moving the packets along the direction of advancement (K) according to the first predetermined motion law, as long as the packets received between the first and the second ring-shaped moving members have not reached a predetermined number of packets, and for moving the packets (101) along the direction of advancement (K) according to a second predetermined motion law that is different from the first predetermined motion law, when the packets received between the first and the second ring-shaped moving members have reached a number of packets equal to the predetermined number of packets, the second predetermined motion law being such that an ordered group of packets (102) is separated by a given distance (D) from remaining packets of the row of packets (120) that find themselves upstream of the first and second ring-shaped moving members (42, 44);

at least one cutting member (72, 74) for cutting the at least one continuous band (62, 64) applied onto the packets (101) at a tract within the given distance (D) between the ordered group of packets (102) and the row of packets (120), so as to separate a strip (104, 106) of adhesive sheet from the at least one continuous band (62, 64), said strip is applied to the ordered group of packets (102) and holds together the packets of the ordered group of packets, wherein the system (60) for applying the at least one continuous band is configured to apply the at least one continuous band (62, 64) onto the packets in a first position (P1) along the sections (42A, 44A) opposed to one another of the first and second ring-shaped moving members (42, 44), and wherein the at least one cutting member (72, 74) is configured to operate on the at least one continuous band in a second position (P2) along the sections (42A, 44A) opposed to one another of the first and the second ring-shaped moving members (42, 44), and wherein the opposed sections (42A, 44A) of the first and second ring-shaped moving members (42, 44) extend downstream of the second position (P2) for such a length that they can contain the ordered group of packets (102), and the opposed sections (42A, 44A) of the first and second ring-shaped moving members (42, 44) extend between the first and the second positions (P1, P2) for such a length that they can receive at least one first packet (101I) of the row of packets (120) that is positioned upstream of the ordered group of packets (102), and wherein the cutting member (72, 74) is movable on a plane that is orthogonal to the direction of advancement (K), and is configured to execute, simultaneously to the cutting, a folding of an end edge (105) of the strip (104, 106) of adhesive sheet separated from the at least one continuous band (62, 64), against a side or a lateral surface (101D) of the ordered group of packets (102), which is orthogonal to the direction of advancement (K), and faces towards the at least one first packet (101I) of the row of packets (120), and a folding of the end edge of the at least one continuous band (62, 64) applied to the at least one first packet (101I) of the row of packets against one side or a lateral surface (101C) of the at least one first packet (101I), which is orthogonal to the direction of advancement (K) and faces towards the ordered group of packets (102).

12. The machine according to claim 11, comprising a pushing unit (80) for pushing the ordered group (102) of packets held together by the strip (104, 106) of adhesive sheet along a direction that is transversal to the direction of advancement (K), for feeding a succession of ordered groups of packets to a collecting station.

* * * * *